US006495003B1

(12) United States Patent
Rosenfeld

(10) Patent No.: US 6,495,003 B1
(45) Date of Patent: Dec. 17, 2002

(54) APPARATUS FOR PRODUCING DECORATIVE BEVERAGE CAN BODIES

(75) Inventor: Aron Marcus Rosenfeld, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/807,432

(22) PCT Filed: Oct. 20, 1999

(86) PCT No.: PCT/CA99/00975

§ 371 (c)(1),
(2), (4) Date: Apr. 23, 2001

(87) PCT Pub. No.: WO00/24951

PCT Pub. Date: May 4, 2000

Related U.S. Application Data

(60) Provisional application No. 60/105,524, filed on Oct. 22, 1998.

(51) Int. Cl.[7] ..... B21D 51/28

(52) U.S. Cl. ..... 204/193; 204/194; 413/70

(58) Field of Search ..... 205/133, 137, 205/145, 151, 170, 172, 183, 198, 201, 202, 206, 213, 220; 427/299, 419.2, 331; 428/34.1, 542.2

(56) References Cited

U.S. PATENT DOCUMENTS

| | | | | |
|---|---|---|---|---|
| 4,400,251 A | | 8/1983 | Heffner et al. | 204/181 |
| 4,909,917 A | | 3/1990 | Harrison et al. | 204/199 |
| 5,120,410 A | | 6/1992 | Herdzina, Jr. | 204/299 |
| 5,164,056 A | | 11/1992 | Loeck | 204/180.2 |
| 5,202,013 A | | 4/1993 | Chamberlain et al. | 205/229 |
| 5,218,472 A | * | 6/1993 | Jozefowicz | 359/584 |
| 5,435,899 A | | 7/1995 | Gimenez et al. | 204/297 |
| 5,445,680 A | | 8/1995 | Hamilton | 134/26 |

FOREIGN PATENT DOCUMENTS

| | | | |
|---|---|---|---|
| EP | WO 92/19795 | | 11/1992 |
| EP | WO 92/19796 | | 11/1992 |
| EP | WO 94/08073 | | 4/1994 |
| EP | WO 00/24951 | | 5/2000 |
| GB | 1 604 035 | | 12/1981 |
| JP | 55-076070 | | 6/1980 |
| JP | 05-232030 A | * | 9/1993 |

OTHER PUBLICATIONS

Brochure—"*Enter The Fourth Decade In Canwashing Technology*", Cincinnati Industrial Machinery, Copyright 1996. (No Month Available).

* cited by examiner

*Primary Examiner*—Edna Wong

(57) ABSTRACT

A process of producing an aluminum beverage can body having a decorative surface exhibiting a dichroic effect when observed in white light. In the process, a can body is formed from a sheet of metal selected from aluminum and aluminum alloy by drawing and ironing, surfaces of the can body are cleaned to produce a cleaned can body, a decorative structure exhibiting a dichroic effect is applied to a surface of the cleaned can body, and the can body is subjected to finishing operations. The decorative structure is applied by the steps of: applying a layer of dielectric material directly onto the metal of the cleaned can body without pre-treatment of the metal with a metal brightener, and forming a semi-transparent metal layer on or within the dielectric layer, the thickness of the dielectric material beneath the semi-transparent metal layer, and the thickness of the semi-transparent metal layer being made effective to produce a visible dichroic pattern when the can body is observed in white light.

1 Claim, 3 Drawing Sheets

APPARATUS FOR PRODUCING DECORATIVE BEVERAGE CAN BODIES

CROSS REFERENCE TO RELATED APPLICATION

This application claims the priority right of provisional application Ser. No. 60/105,524 filed Oct. 22, 1998 by applicants herein, and is the national phase of international application PCT/CA99/00975, filed Oct. 20, 1999.

TECHNICAL FIELD

This invention relates to the decoration of beverage cans made of aluminum or aluminum alloys. More particularly, the invention relates to the decoration of such beverage cans, or can bodies, by providing the cans with a visible dichroic effect.

BACKGROUND ART

In the beverage market, there is an ever-present need for manufacturers and sellers to differentiate their products from those of their competitors. One way of achieving this is to produce beverage containers that are noticeably different from others or are especially attractive. This can be done by creating containers, such as aluminum beverage cans, having novel shapes or decorative effects. To this end, it has been suggested that beverage cans may be provided with outer surfaces exhibiting dichroic effects, i.e. colours that change hue when viewed from different angles. Products exhibiting such effects are highly noticeable and attractive, and thus satisfy marketing requirements very effectively.

Techniques for producing dichroic effects are well known. Generally, pairs of reflective surfaces are separated from each other by distances in the order of the wavelength of light so that, when light reflected from the two surfaces combines, interference effects are produced that enhance certain light frequencies and suppress others. These frequencies change with the angle of view because the effective separation between the respective surfaces changes according to the path followed by light rays reflected and view at different angles.

One way of producing dichroic effects is to produce a so-called "metal-dichroic-metal" (MDM) structure. Frequently, the dichroic material is a metal oxide, so this type of structure is often referred to as a "metal-oxide-metal" (MOM) structure. Examples of such structures, and their methods of formation, are disclosed, for example, in the following patent publications: (1) U.S. Pat. 5,218,472 issued to Jozefowicz et al. on Jun. 8, 1993 and assigned to the same assignee as the present application; (2) International (PCT) patent publication WO 92/19795 (based on International application PCT/CA92/00192), published on Nov. 12, 1992, inventors Jozefowicz et al., and assigned to the same assignee as the present application; (3) International (PCT) patent publication WO 92/19796 (based on International application PCT/CA92/00201), published on Nov. 12, 1992, inventor Mark Adrian Jozefowicz et al., and assigned to the same assignee as the present application; and (4) International (PCT) patent publication WO 94/08073 (based on International application PCT/CA93/00412), published on Apr. 14, 1994, inventor Mark Adrian Jozefowicz, and assigned to the same assignee as the present application.

Dichroic structures of this kind are often produced in the form of thin vacuum metallized polymer films that are adhered to substrates to be decorated (for example, the anti-forging foil patches presently used on Canadian paper currency). The use of such film and foil structures, eg. dichroic shrink films or labels, to decorate beverage cans would be both expensive and would require additional steps that would not conveniently integrate into the conventional processes used for the manufacture of can bodies. The production of dichroic effects by this means is therefore believed not to be commercially viable.

Dichroic structures have been directly produced on non-foil substrates, e.g. on metal sections and components used for architectural applications. However, it has not been possible to produce such structures without the use of brighteners required to make the underlying surface of the substrate material sufficiently reflective for observation of the dichroic effect. Again, the incorporation of a brightening treatment into a process for the production of can bodies is not seen as commercially attractive, both because of the cost of the brightening materials and the lack of easy integration of this extra step into the conventional can-making operation.

There is consequently a need for a way of producing a beverage can body having a visible dichroic surface that can be operated inexpensively and conveniently.

DISCLOSURE OF THE INVENTION

An object of the invention is to provide a process of producing a beverage can body having a surface exhibiting visible dichroic effects.

Another object of the invention is to provide such a process that can be integrated without undue difficulty into conventional can-making operations and equipment.

Another object of the invention is to provide a process of producing beverage can bodies exhibiting a visible dichroic effect without employing films and foils that are adhered to the can body subsequently to its production.

Another object of the invention is to enable dichroic structures to be produced directly on aluminum can bodies in a cost effective manner.

According to one aspect of the invention, there is provided a process of producing an aluminum beverage can body having a decorative surface exhibiting a dichroic effect (when observed in white light), in which a can body is formed from a sheet of aluminum metal or aluminum alloy metal by drawing and ironing, surfaces of the can body are cleaned to produce a cleaned can body, a decorative structure exhibiting a dichroic effect is applied to a surface of the cleaned can body, and the can body is subjected to finishing operations, wherein the decorative structure is applied by the steps of: applying a layer of dielectric material directly onto the metal of the cleaned can body without pre-treatment of the metal with a metal brightener, and forming a semi-transparent metal layer on or within said dielectric layer, the thickness of said dielectric material beneath said semi-transparent metal layer, and the thickness of said semi-transparent metal layer being made effective to produce a visible dichroic pattern when said can body is observed in white light.

According to another aspect of the invention, there is provided an apparatus for producing beverage can bodies from aluminum sheet can stock, including a cupper to form a cup from said can stock, an apparatus for drawing the cup into a can body, an ironer for ironing can body sides, a wash apparatus for cleaning the drawn and ironed can body, and finishing apparatus for finishing the can body, wherein anodizing equipment for anodizing a surface of the can body to form an anodic dielectric spacer layer is provided immediately after the washer, followed by a device for depositing a semi-transparent metal layer, said equipment and said device effective to form a structure on said surface that exhibits a dichroic effect when viewed in white light.

The invention also includes decorated can bodies produced by the above process, and complete beverage cans incorporating such decorated can bodies.

The present invention is based on the unexpected finding that a beverage can body produced by drawing and ironing has a surface, when cleaned, that is sufficiently bright and reflective that a dichroic structure can be created directly on the surface without the need for pre-treatment with brighteners or other chemical or physical agents. This is surprising because, as noted above, brightening treatments are normally required when dichroic structures are formed directly on non-foil metal substrates. The only material (other than vacuum deposited layers) previously known to the inventors that did not require the use of brighteners was aluminum household foil, which is of much thinner gauge than can body walls.

It has also unexpectedly been found that, by avoiding the need for such pre-treatments, (ie. by forming the dichroic structure in the absence of metal brighteners, namely directly on the metal of a cleaned can body) the process of the invention can be carried out in an automated production line for the formation of can bodies from metal sheet, and specifically the process can be incorporated into conventional can body washing and pre-treatment regimes. The steps for applying the decorative dichroic structure may be carried out automatically following the automatic washing operation conventionally employed for forming the cleaned can body stock. It has been found that the times required for the formation of the dichroic layer and the semi-transparent metal layer are consistent with the speeds of various other steps required for can body formation, so that easy integration is possible.

Normally, the layer of dielectric material beneath said semi-transparent metal layer is made to have a thickness in the range of 0.3 to 1.0 $\mu$m, and the semi-transparent metal layer, preferably nickel, is formed at a thickness in the range of 5 to 10 nm, most preferably by electroless metal plating.

The dielectric material is preferably a metal oxide, e.g. aluminum oxide, ideally formed by electrolysis of the underlying aluminum or aluminum alloy of the cleaned can body. Surprisingly, the electrolysis may be achieved by directing a spray of liquid electrolyte at said can body from a nozzle while creating an electrolysis circuit in which said can body is made an anode and said nozzle is made a cathode. Alternatively, the electrolysis may be carried out by at least partially immersing the cleaned can body in a liquid electrolyte while creating an electrolysis circuit in which the can body is made an anode and a cathode is brought into contact with the electrolyte.

The electrolyte used for the electrolysis is preferably a dilute aqueous solution of sulfuric acid. To produce a dielectric layer of the required thickness, the electrolysis normally requires a period of time which is fast enough for incorporation of this step into a conventional can body production process.

When the electrolysis is brought about by spraying the electrolyte, the can body may be held in place by a wire mesh, or a pair of wire meshes, one of which is in electrical contact with the can body and forms part of the electrolysis circuit. Most preferably, the can body is held inverted by the mesh and the spray is directed over an outer surface of the can body from above, so that only the outside of the can body is anodized. The spray is preferably continuous when it contacts the can body, but is discontinuous when it makes direct contact with the mesh. This avoids direct shorting of the electrical circuit between the nozzle and the mesh.

If desired, the spray may be created in a flow pattern that directs different amounts of the liquid electrolyte against different parts of the can body. Alternatively, the current input to the spray may be varied during the spray anodizing process, e.g. by providing less current density around the edges of the spray pattern. This causes different rates of electrolysis at different parts of the can body, and causes the finished can body to exhibit different colours in different areas due to different thicknesses of the dielectric layer.

Also if desired, the can body, following the applying of the decorative dichroic pattern, may be overcoated with a further decorative layer that is at least partially coloured and at least partially transparent. For example, the colour of the overcoat may be such that it enhances the perceived dichroic effect when the can body is moved relative to an observer.

Also if desired, the can body is produced with a fluted outer surface to enhance a dichroic effect produced by the dichroic layer, i.e. by producing different colours at different parts of each flute, giving the can a vertically striped appearance.

After the formation of the dichroic structure in the process of the present invention, the finishing operations of the can body may include the application of a protective sealing layer over said dichroic structure, both for protection against physical abrasion, and to prevent modification of the dichroic effect by fingerprints and the like, although the structures of the invention do not seem very prone to this type of modification.

There have been suggestions for the use of anodization for the cleaning of can bodies. In such cases, the electrolysis used for cleaning may be combined with the electrolysis used to apply the layer of dichroic material, thus simplifying the overall procedure.

BEST MODES FOR CARRYING OUT THE INVENTION

Figure 1:
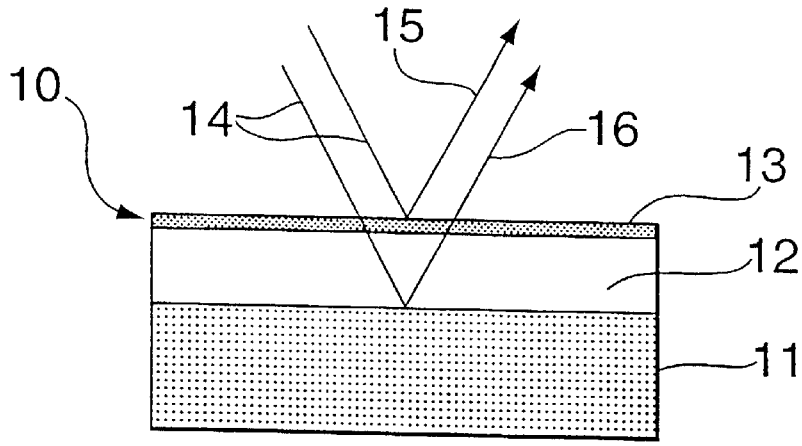
FIG. 1 is a simplified cross-section of an example of a dichroic structure of the type that may be created in the present invention.

As previously noted, dichroic effects are realized by particular optical thin film structures that appear coloured as a result of light interference (when viewed in diffuse white light). As illustrated in FIG. 1, one such interference film structure 10 (a trilayer film) consists of a reflective metal base layer 11, a dielectric spacer layer 12 and a semi-transparent metal overlayer 13—a so-called metal-dielectric-metal (MDM) structure. Light 14 incident on the trilayer film structure 10 is partially reflected (ray 15) by the top semi-transparent metal layer 13. Some of the light is also transmitted through this layer to the metal base layer 11 where it is reflected (ray 16) and re-emerges from the film. The light rays 15, 16 reflecting off the top and base layers re-combine either constructively or destructively at each wavelength so that some colours, i.e. wavelength ranges, are enhanced while others are suppressed. The film can be strongly coloured if the top and base layer metals are judiciously chosen (type of metal and thickness). The actual colour seen is determined by the thickness of the dielectric spacer layer 12, which is typically in the submicron range (i.e. less than 1 $\mu$m).

Such a structure, by itself, is not necessarily dichroic in appearance. Dichroic effects are realized in an MDM structure that is strongly coloured when, additionally, the index of refraction (n) of the dielectric layer is low and the thickness of the layer is within a prescribed range (normally 0.3 to 1 $\mu$m). Typical indices of refraction (n) for oxide dielectric materials are in the range of n=1.4–2.4. Optimal dielectrics, i.e. those which generate strong colours and show the largest colour shift with angle, include silicon dioxide (n=1.46), magnesium fluoride (n=1.38) and aluminum oxide (n=1.65).

The illustrated MDM structure is the simplest optical thin film structure, from the point of view of the number of layers involved, that is capable of generating strong colours and dramatic dichroic effects. More complicated structures, with additional metal/dielectric layers or based on all-dielectric multilayers, are known that can produce specific colours or colour shifts not accessible with the MDM structure. Examples of such structures are shown, for example, in U.S. Pat. No. 5,218,472. All of these structures are included within the scope of the present invention, although the simplest trilayer structure is the most preferred for simplicity and economy. The behaviour (colour and colour shifting properties) of such structures are readily modeled given known optical properties of the metals and dielectrics.

All of these structures may be made by vacuum deposition methods, such as sputtering and evaporation, and such methods of fabrication may be employed in the present invention; however, this is not preferred. It is most preferable that the dichroic structures of the present invention be made by a combination of anodization and electroless metal plating techniques. In this way, the process for the production of the dichroic structure may be incorporated into conventional commercial can production, washing and surface treatment processes, which is a significant and unexpected advantage.

Figure 2:
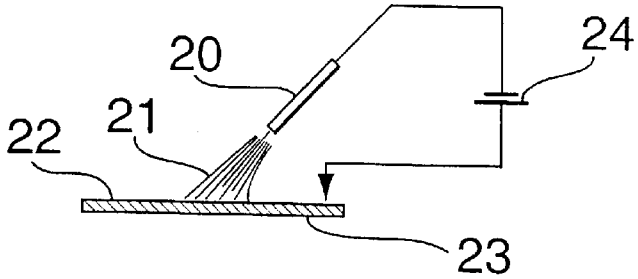
FIG. 2 is a simplified illustration of a spray anodizing technique of the type that may be used in the present invention.

The anodization to form the dichroic spacer layer 12 may take the form of spray anodizing or immersion anodizing. FIG. 2 illustrates the basic concept of spray anodizing in which an electrically conductive nozzle 20 sprays a stream of conductive electrolyte solution 21 onto a surface 22 to be anodized of a metal substrate 23. The nozzle 20 is connected as a cathode to a voltage generation device 24 (e.g a battery or DC transformer), and the metal substrate 23 is connected as an anode. Anodization of the surface 22 takes place only where the stream of electrolyte contacts the metal surface 22, provided the stream 21 is unbroken between the nozzle 20 and the surface 22 and thus remains electrically conductive. The anodization normally requires a period of time in the range of 30 to 60 seconds when the substrate metal is aluminum and the dichroic layer is to be grown to a thickness suitable for the generation of a dichroic effect (typically 0.3 to 0.8 $\mu$m, which covers the range of most interesting colours and colour shifts). Suitable electrolytes and concentrations are known to persons skilled in the art, but preferably the electrolyte is an aqueous solution of sulfuric acid. The electrolyte used for the spray may, of course, be collected in a suitable reservoir and re-used, i.e. a pumping device (not shown) used to supply electrolyte under pressure to the spray nozzle may draw the electrolyte from the collection reservoir. Fresh electrolyte may be added as required to compensate for losses and to maintain the required concentrations of solutes.

Figure 3:
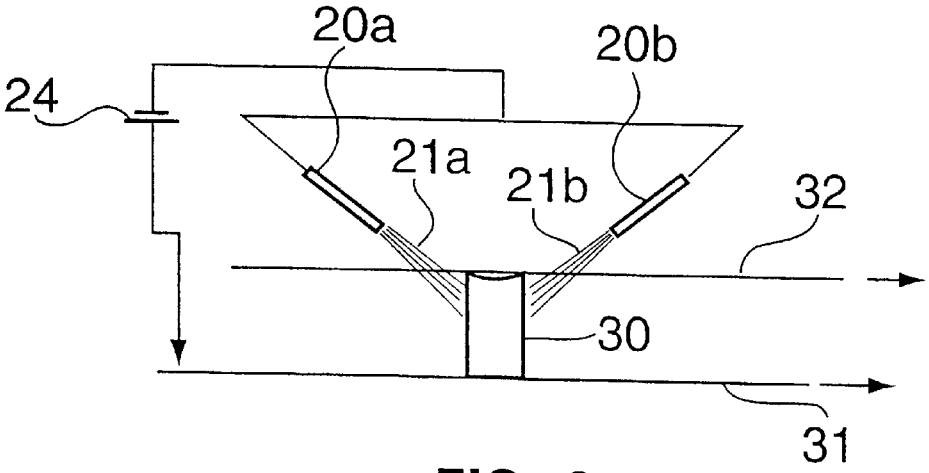
FIG. 3 is an illustration similar to FIG. 2 showing spray anodizing of a formed can body.

For example, the outside surface of a newly ironed and washed can body may be spray anodized in the manner indicated in FIG. 3. In this arrangement, a can body 30 (only one is shown for simplicity, but there would of course be a procession of such can bodies in a commercial operation) is supported in an inverted (open end down) orientation between a moving metal support mesh conveyor 31 and a moving stabilizing mesh conveyor 32, the latter providing pressure on the can body from the top, thus ensuring that the can body is firmly held in place between the two mesh conveyors that move in the direction of the arrows at the same speed through the anodizing apparatus. Electrically conductive nozzles 20*a*, 20*b* are arranged above the path of the can body, directed downwards at angles so that electrolyte sprays 21*a*, 21*b* contact the side surfaces of the can body in the manner shown. While only a pair of nozzles 20*a*, 20*b* is shown, more may be provided, as required, to surround the can body 30 and to ensure that the spray covers as much of the outer surface of the can body 30 as is desired. A voltage generation device 24 is connected as illustrated to the lower metal support mesh conveyor 31 and to the nozzles 20*a*, 20*b*. The can body 30 thus becomes an anode and the nozzles become cathodes, permitting anodization to proceed. The inverted orientation of the can body 30 ensures that the insides of the can body are not anodized. If treatment of both the inside and the outside of the can body were desired, a second bank of spray nozzles (not shown) could be provided in an upward spraying configuration beneath the mesh conveyor 31. While there would normally be no reason to provide a dichroic structure inside a can body (as the inside is rarely seen in use), such a bank of nozzles could be employed for electrolytic cleaning of the inside of the can body.

Figure 4:
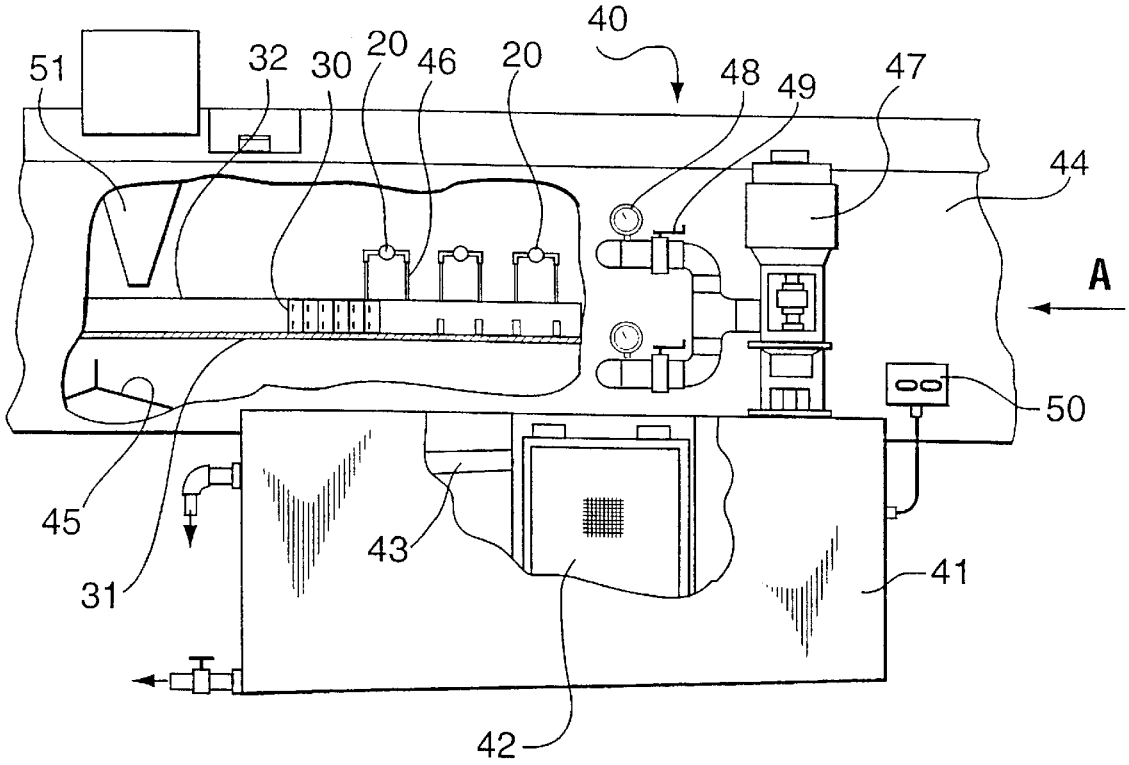
FIG. 4 is a side view partially cut away showing apparatus for carrying out the anodizing process of FIG. 3.

FIG. 4 is a side view, partly cut away, of a spray treatment apparatus that may be used for a spray anodization step described above (or the spray electroless metal plating step described later) in this description. The apparatus 40 is supported by a chemical tank 41 acting as a reservoir for the electrolyte. The tank 41 incorporates a removable screen 42 for removing particles from the electrolyte as it is recycled. The tank also includes an overflow trough 43 for removal of excess electrolyte during operation of the apparatus. A spray chamber 44 contains a drain pan 45 at the lower end thereof for collecting spent electrolyte and returning it to the tank 41. A moving metal support mesh conveyor 31 travels through the spray chamber 44 in the direction of arrow A (note that the direction of travel is opposite to that of FIG. 3), and a second stabilizing mesh conveyor 32 moves in parallel to fix can bodies 30 in place. As in the case of FIG. 3, the lower mesh conveyor 31 is connected to a circuit (not shown) to make the cans anodic. A series of spray risers 46 and nozzles 20 is provided in the spray chamber with the nozzles directed to spray jets of electrolyte downwards over the exterior surfaces of the inverted (open end down) can bodies 30. The nozzles 20 are made of metal and are connected as cathodes in the electrolysis circuit. The electrolyte is fed under pressure to the nozzles 20 from the tank 41 via pump 47. The pressure is monitored by pressure gauge 48 and can be controlled by a flow regulating valve 49. The temperature of the electrolyte in the tank 41 may also be monitored by a temperature gauge 50. At the outlet end of the spray chamber, a blower tube 51 for air is provided to help the treated can bodies drain and dry. As the can bodies 30 pass through the spray chamber 44, their outer surfaces are sprayed by streams of electrolyte and anodization takes place. The used electrolyte is collected by drain pan 45 and returned to the tank 41 via removable screen 42. The electrolyte collected in the tank 41 is then available for re-use upon being collected by pump 47 and re-directed under pressure to the nozzles 20. In this way, the desired anodization can be carried out on a continuous basis as newly-produced can bodies emerge from conventional production and washing apparatus.

The spray of electrolyte should contact the sidewalls of the can body as an un-interrupted stream and produce a continuous sheath of electrolyte over the can surface (or at least the part of the surface to be coloured). Also, the spray should be broken up into a distinct droplet stream by the time that it impinges on the lower mesh conveyor 31 in regions where a can body does not interrupt the stream; this prevents direct short-circuiting of the nozzle cathode to the anodic conveyor mesh.

The illustrated apparatus is similar in many respects to known washing equipment and to known equipment used to electrophoretically coat the inside and outside of can bodies with lacquer as an alternative to the now conventional processes of spray coating (for the inside lacquer) and roller coating (for the outside lacquer). The electrophoretic deposition process is similar to anodizing, so similar equipment and techniques may be employed. The only essential difference in carrying out the two processes is that the electrolyte is a polymeric solution in the former case and an acid solution in the latter (along with different typical voltages and current densities used in the two processes). Typical apparatus and techniques are disclosed, for example, in British patent 1,604,035 and U.S. Pat. Nos. 4,400,251, 5,164,056 and 5,435,899.

Figure 5:
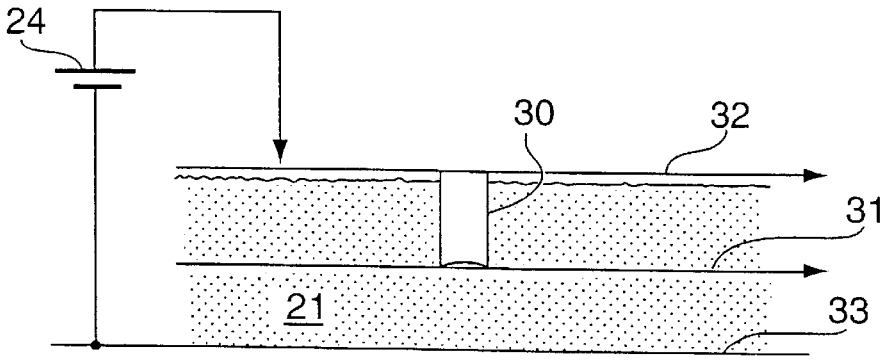
FIG. 5 is an illustration of a technique for immersion anodizing of a formed can body, the technique being suitable for use in the present invention.

A simple illustration of how the anodizing might be implemented in the immersion mode is given in FIG. 5. A can body 30 (one of a procession) is again supported on a mesh conveyor 31 with an upper mesh conveyor 32 to hold the can body in place. The top mesh conveyor 32 is arranged outside a reservoir of the electrolyte 21 and is biased anodically by the voltage generation device 24. The majority of the can body (in the opening facing the top orientation is immersed within the reservoir of the electrolyte. A second mesh 33 underlying the supporting mesh conveyor 31 or, alternatively, a configuration of electrodes (not shown), immersed in the electrolyte serves as the cathode. In this case, a space at the top of the can must be left uncoated so that the top mesh does not contact the electrolyte and short to the cathode directly through the electrolyte.

Again, immersion type electrophoretic deposition of lacquers is known, so that these may be used for the immersion anodization of the present invention. Known devices of this kind include turret-fed systems where individual can bodies are enclosed in a housing which is filled with electrolyte and then flushed clean for successive processing of individual can bodies. Such a system may be applicable to the MDM process of the present invention for small volume applications and if the anodizing step is separated from the subsequent electroless deposition step. However, this type of design is most appropriate for an electrolytic process lasting at most a few seconds as is the case for lacquer deposition; otherwise can body throughput is severely compromised by such a successive processing approach. For the present application, processing of cans while they are being transported in massed flow is the preferred approach as described above.

Following anodization to form the dielectric spacer layer, the semi-transparent metal layer is applied, preferably by electroless-metal plating. This type of metal plating is well known in the art and is described, for example, in U.S. Pat. No. 5,218,472 referred to above. Most preferably, following anodization, the can body is rinsed in water and then subjected to an electroless nickel plating technique. This follows the conventional three step process consisting of immersion in tin chloride (so called sensitization step), rinsing, immersion in palladium chloride (nucleation), rinsing, followed by immersion in Ni plating solution and final rinse. The residence time for the sensitization and nucleation steps is normally 30–60 seconds. It is possible that these two steps may be collapsed to one using a suitable combined reagent. The residence time for the Ni plating is typically 5 to 10 seconds. The thickness of Ni required is generally 5–10 nm, while the actual amounts of Sn and Pd deposited are well below an atomic monolayer. All of these steps can be accomplished by fully submerging the can in the successive reagents or by spraying the can successively with the reagents.

As noted, the electroless deposition of the semi-transparent metal layer may be carried out by either a spray process or an immersion process, and both make possible very simple methods for patterning into coloured and un-coloured (metallic) areas. This is accomplished by omitting treatment in the not-to-be-coloured areas with any step of the Sn/Pd/Ni sequence. For spray coating, this can be achieved using directed sprays.

Also, by varying the spray pattern in the anodizing stage, e.g. the actual spray fan pattern or angle of impingement, gradations in anodic film thickness over the can surface can be achieved that will lead to multicolour patterns when the surface is subsequently uniformly metallized. For example, heavier spray near the top of the can, by changing the angle of impingement, may yield a top-to-bottom colour variation. Using a spray pattern that is not uniform across the fan width may yield longitudinal streaks along the length of the sidewall.

As noted above, the anodization and metal deposition steps of the present invention may be incorporated into conventional commercial processes for the production of can bodies, thus allowing substantial economy and ease of operation.

Figure 6:
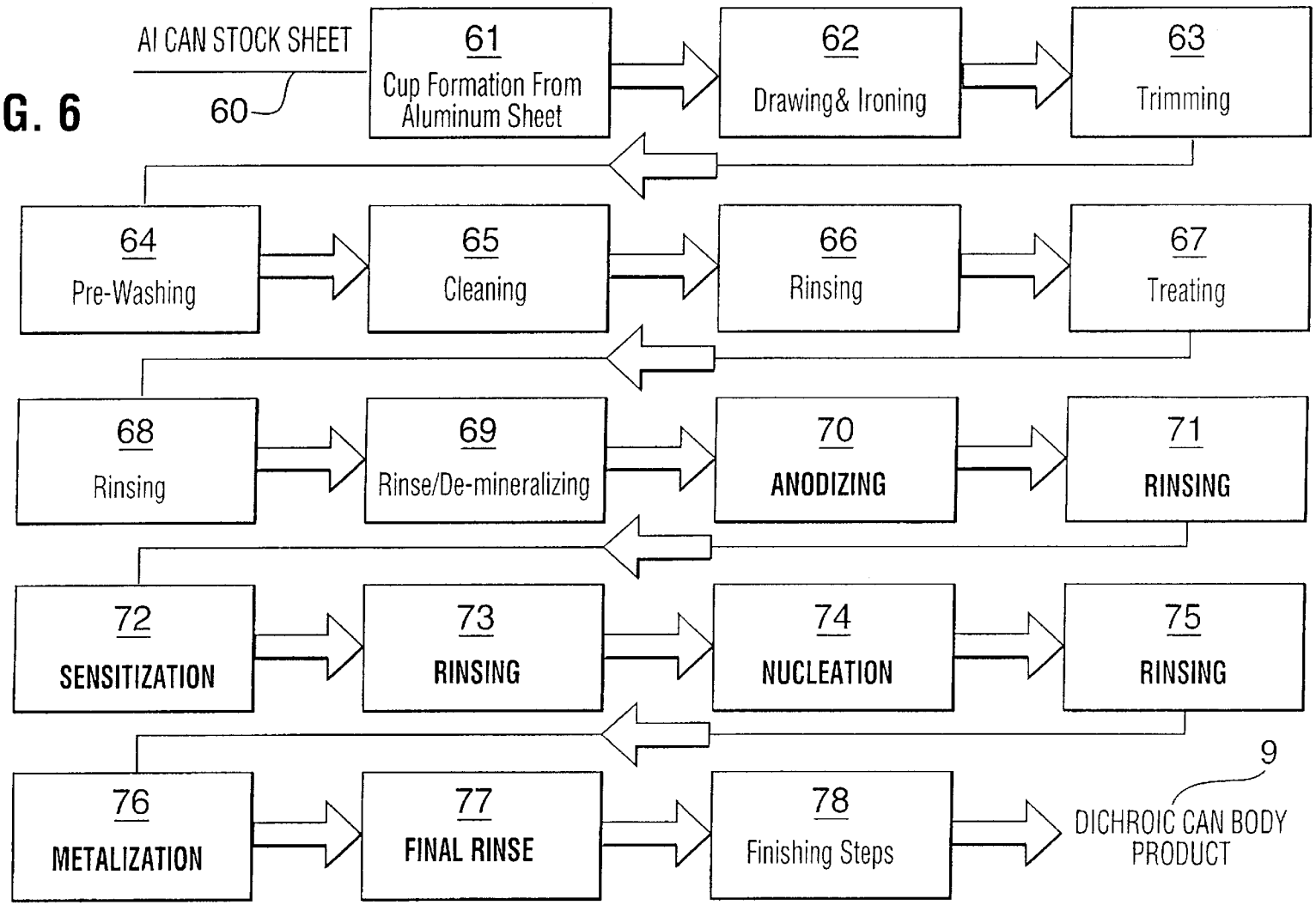
FIG. 6 is a flow diagram illustrating steps in a process of can body fabrication including steps for the production of a surface exhibiting a dichroic effect (these steps being shown as boxes having round corners).

As illustrated in simplified flow sheet form in FIG. 6, can bodies are conventionally made from a coil of aluminum can body stock 60. The first step 61 in the manufacturing process is to form a cup. Typically, after uncoiling and lubricating of the sheet, cups are turned out by a high speed cupping press having up to 14 dies and operating at up to 250 strokes/min. Trackwork separates the cups into a number of single file streams which feed individual bodymakers that form the can bodies from the cups by drawing and ironing. Typically each bodymaker can take cups at a rate of up to 250 cans/min so up to 14 of these are set up to handle the output of one cupper press. Cans are drawn to final diameter and then ironed to the final wall thickness, step 62. From each bodymaker, the cans are transported through trackwork to a dedicated trimmer where they are trimmed to length, step 63. From the trimmer, the cans are discharged onto a mat-top conveyor on which they are able to drip and lose much of the lubricant with which they are coated. From the conveyor, the can bodies are fed into a vacuum inverter which rotates them from an open-end-up orientation to an open-end-down orientation suitable for the wash stage. The can bodies are then transferred from the inverter to a horizontal air conveyor which serves to accumulate the cans as they are transported to the washer. An area providing a few minutes of accumulation (not shown) may be provided so that the cupper and bodymakers can continue to work if the washer stops briefly. A solid pack of can bodies is presented to and handled in the washer which involves a multi-stage spray processing operation.

The wash process is designed to thoroughly remove all contaminants from the drawn and ironed can body and to prepare the can body surface to receive interior and exterior organic coatings (in the conventional process). The types of contaminants that must be cleaned include residual rolling mill oil and smut, cupper and bodymaker lubricants, aluminum fines generated during the cup and can forming process and tramp (hydraulic) oils from forming equipment that leaks into the soluble oils system. Optional conventional surface treatment within the washer may consist of applying either a thin conversion coating, to promote adhesion of coatings, prevent dome staining during pasteurization of beer and to enhance corrosion resistance of the inside can surface, or applying a coating to enhance mobility of cans in the various can transport systems used in subsequent processing of the cans.

The overall process typically comprises six steps: pre-washing 64, cleaning 65, rinsing 66, treating 67, rinsing 68, rinse/de-mineralizing 69, as illustrated in FIG. 6. The pre-wash uses a dilute $H_2SO_4$/HF solution to remove the heavy accumulation of soluble oils on the can body's surface before entering the cleaning stage. Cleaning uses a $H_2SO_4$/HF/surfactant mix to remove aluminum fines, native oxide and rolling oils from both the interior and exterior of the cans. All chemicals used are typically obtained in optimized commercial formulations such as the Ridolene™/Alodine™ cleaning/treating package from Amchem. The spray time is approximately 60 seconds at a pressure of 241.3166 kPa (35 psi) and temperature of 50° C. Typically 20–30 mg of Al metal is removed per can body, and the can surface will be water-break-free after this stage. Failure to completely remove the organic soils (oils, lubricants) will result in incomplete or non-uniform conversion coating which will lead to adhesion problems. Over-etching the cans may result in cans having poor mobility or in difficulties at the decorating stage because the can surface is too rough. Under-etching may leave oxide and entrained rolling oil that can generate so-called bleed through defects after decorating. The third stage rinse stops the chemical etching and removes residual cleaning solutions and soils.

The fourth stage can be used to apply a thin Zr-based chemical conversion coating (coating weight 20 mg/$M^2$). Spray time is 15–30 seconds at about 68.9476 kPa (10 psi) and a temperature of 32° C. Excessive treatment can result in poor can mobility or in interior metal exposure or ink adhesion loss since the conversion coating is brittle and can crack or flake off if too thick. The fifth stage rinse removes residual coating solution which otherwise would continue to react with the Al surface. The final stage 69 is a de-ionised water rinse that removes minerals such as calcium, silicates and phosphates from the can surface. Any minerals left on the can surface could affect adhesion of organic coatings or cause water spotting that may result in show-through on some labels. A dry-off oven (not shown) at the exit of the washer removes all water from the can surface.

The process of the present invention can be incorporated at this stage of the conventional process. To realize the dichroic film, the anodizing step is carried out by spray anodizing with sulphuric acid corresponding to the stage 1 cleaning step with sulphuric acid in the normal wash process. The final bank of spray nozzles in this stage is used for rinsing. The sensitization step is carried out in stage 2 followed by the stage 3 rinse. Nucleation is carried out in stage 4 followed by the stage 5 rinse. The Pd deposition and final rinse are carried out with the spray banks in stage 6. Several modifications of this set-up are possible depending on the actual minimum spray times required in each step and whether the sensitization and nucleation steps can be collapsed to one step. Also, it may be advantageous to combine the anodizing with the cleaning stage in a separate machine. This would allow the prospect also of carrying out electrolytic cleaning of cans.

For example, as shown in FIG. 6, a can body carrying a uniform dichroic finish around the whole sidewall exterior may be produced by washing the as-drawn-and-ironed can in the indicated manner, anodizing 70 the can surface to produce an anodic film in the thickness range of 0.3–1.0 .mu.m, rinsing 71 the anodized can body, and then metallizing the surface of the anodic film with a thin semi-transparent layer of metal 5–10 nm in thickness, by electroless deposition involving the steps of sensitization 72, rinsing 73, nucleation 74, rinsing 75, and metallization 76, followed by a final rinse 77. Following the deposition of the semi-transparent metal in this way, the conventional finishing steps 78 may be carried out, if desired, e.g. coating with organic protective layers, further decoration, etc. The final product 9 (not shown) is a can body having a dichroic surface suitable for delivery to beverage manufacturers for filling and lidding to create finished beverage cans.

As noted above, the invention is based in part, at least in its preferred forms, on the unexpected realization that the number of process steps, the nature of these steps and the required residence times are similar to what is required in the normal can washing process. The entire process can thus be carried out in equipment and with throughputs consistent with the conventional can making operation.

Preferably, although not necessarily, the anodizing is carried out in sulphuric acid electrolyte and the metallization layer is Ni. This produces a film/substrate structure consisting of: reflective Al substrate/anodic film dielectric spacer layer/semi-transparent metal layer, i.e. the required metal/dielectric/metal (MDM) structure, which is coloured by light interference and exhibits the dichroic effect for the given materials and thickness ranges.

The invention recognizes and exploits the fact that the ironed aluminum can surface is highly reflective and can function as the base layer in an MDM structure to yield vibrant colours without the use of brighteners (this is not the case for steel, for example). Also the diameter of the conventional can is such that the resulting curvature yields an appealing variation in colour around the can surface when a dichroic structure is viewed, even without tilting the can. The flip-flop colour effect found when the can is actually tilted back and forth is an additional promotional feature. The resulting MDM surface can be subsequently printed and decorated in the conventional manner. Furthermore, patterning of the MDM coating is possible by a number of process variations as described below.

Surprisingly, it has been found that the MDM films produced as indicated above are not fingerprint sensitive, i.e. do not show a colour change under fingerprints, unlike many conventional dichroic films. This is despite the fact that the anodizing parameters, in general, are similar to those used for the production of porous anodic films when grown much thicker. Without wishing to be limited to a particular theory, this is attributed to a self-sealing action of the very thin anodic films. This may be due to the film sealing during the anodizing or the subsequent rinse or possibly to sealing taking place, via the normal hydrothermal sealing mechanism, in the elevated-temperature, water-based Ni deposition step. Thus the film, as produced, is different from many conventional films, and this characteristic may make subsequent sealing steps unnecessary, further reducing the cost of the overall process. It is expected, however, that the dichroic structure of the present invention will still benefit from being overcoated, after further decoration and printing (if any), with a polymeric overvarnish typical of conventional can body production.

Combining a dichroic finish with a fluted can sidewall will yield sharper colour transitions around the can which may enhance the aesthetic appeal of the finish. The procedure for producing fluted can bodies is well known to persons skilled in the art and need not be described in detail here. Basically, this is part of the drawing and ironing step.

It is possible to include absorbing pigments in the organic overvarnish or printing above the MDM structure to allow the dichroic interference to be combined with colour absorption to realize additional optical effects. For example, the colour shift of the dichroic effect can be made very abrupt with angle (as opposed to continuously varying through a sequence of colours) by selectively absorbing the intermediate colours.

The invention is described in more detail below with reference to the following Example, which is not intended to limit the scope of the present invention.

EXAMPLE

MDM Formed on a Can by Successive Immersion Treatments

A bright can body was cleaned in a conventional alkaline cleaner to remove soils from manual handling (this step is not needed when cans go directly from the conventional wash process to the MDM process). The can body was then anodized in an aqueous solution of 165 g/l $H_2SO_4$ at 16 volts DC (15 amp/dm$^2$) and 20° C. for 30 seconds. The can was rinsed under flowing water for several seconds then immersed in an aqueous solution of 1 g/l $SnCl_2$ for 1 minute at room temperature. The can body was then immersed in water for 1 minute and then in an aqueous solution of 0.5 g/l $PdCl_2$ for 1 minute at room temperature. After rinse immersion for 1 minute, the can body was immersed in a commercial electroless Ni formulation, supplied by Ample Chemical Products Ltd, for 7 seconds with the bath held at 86° C. The can body was finally rinsed and blown dry.

The resulting can body was a bright red colour which changed to golden yellow as it was tilted through about 45 degrees. When the can body was viewed standing upright on a table, it was red over the central region nearest the viewer and changed to golden yellow near the peripheries.

A second can body was put through the same procedure but with an anodizing time of 45 seconds. This can body was blue and changed to apple-green on tilting. A number of other distinctive colours and colour shifts are available with anodizing times in the 30–90 second range.

What is claimed is:

1. An apparatus for producing beverage can bodies from aluminum sheet can stock, comprising a cupper to form a cup from said can stock, an apparatus for drawing the cup into a can body, an ironer for ironing can body sides, a wash apparatus for cleaning the drawn and ironed can body, wherein anodizing equipment for anodizing a surface of the can body to form an anodic dielectric spacer layer is provided immediately after the washer, followed by a device for depositing a semi-transparent metal layer on said dielectric spacer layer, said equipment and device effective to form a structure on said surface that exhibits a dichroic effect when viewed in white light.

* * * * *